US005318376A

United States Patent [19]

Prescott, Sr.

[11] Patent Number: 5,318,376

[45] Date of Patent: Jun. 7, 1994

[54] MANHOLE FRAME

[76] Inventor: Everett J. Prescott, Sr., P.O. Box 420, Gardiner, Me. 04345

[21] Appl. No.: 986,605

[22] Filed: Dec. 7, 1992

[51] Int. Cl.[5] ..... F02D 29/14

[52] U.S. Cl. ..... 404/25; 404/26

[58] Field of Search ..... 404/25, 26

[56] References Cited

U.S. PATENT DOCUMENTS

| | | | |
|---|---|---|---|
| 3,331,295 | 7/1967 | Sorrell | 404/26 |
| 3,611,889 | 10/1971 | Levinson | 404/26 |
| 3,712,009 | 1/1973 | Campagna | 404/25 X |
| 4,203,686 | 5/1980 | Bowman | 404/25 |
| 4,337,005 | 6/1982 | LeBaron | 404/26 |
| 4,449,715 | 5/1984 | Gagas | 404/25 X |
| 4,968,600 | 7/1976 | Bowman | 404/26 X |
| 5,044,818 | 9/1991 | Pritchard | 404/25 X |
| 5,205,668 | 4/1993 | Adams | 404/26 |
| 5,211,504 | 5/1993 | Trudel | 404/26 |

*Primary Examiner*—Mark Rosenbaum
*Assistant Examiner*—Frances Han
*Attorney, Agent, or Firm*—William Nitkin

[57] ABSTRACT

A manhole frame having a top with an opening therein defining a cover seat area, a side wall extending downward from the top to an inwardly extending lower flange, the exterior of the side wall being outwardly extending at its top and inwardly extending at its lower portion down to an inwardly extending lower flange. Also disclosed is a method of installing and raising the manhole frame to a new level.

6 Claims, 6 Drawing Sheets

MANHOLE FRAME

BACKGROUND OF THE INVENTION

1. Field of the Invention

The field of this invention resides in the area of manhole frames and more particularly relates to adjustable manhole frames which are easily raisable to new pavement heights.

2. Description of the Prior Art

The standard practice in manhole installations is to supply precast concrete manholes which are assembled at the job site. These manholes extend from the depth of the pipe up to its top cone which is disposed about 12 inches below the road surface. This 12-inch space is for the installation of a manhole frame and cover which assemblies vary in height from 4 to 10 inches. The void between the bottom of the manhole frame's outwardly extending bottom flange and the cone of the concrete manhole is filled with either brick, mortar, brick and mortar, cement block and mortar, or precast concrete rings mortared in.

After installation of the frame, available fill material consisting of gravel or a combination of gravel and dirt is deposited around the exterior of the manhole cone and manhole frame above its outwardly extending bottom flange, and the fill is then compacted with whatever means is available, leaving 2 inches or more on top for the final paving material. Invariably, settling occurs within a short period of time resulting in a separation and cracking of the final paving around the frame. This settling process causes potholes to develop that require constant patching. Over a period of time seepage of surface liquids such as water, gasoline, oil, and in cold climate areas, water carrying salt causes deterioration of the support base under the manhole frame. In areas of severe deep frost penetration, entire sections of the frame and its base can be lifted above the road surface. A great number of these structures have to thus be repaired which repair necessitates extensive and expensive digging out of the entire manhole frame and the subsequent rebuilding of its base.

At the present the vast majority of manhole frame members are of the non-adjustable type, therefore any needed repair necessitates digging them entirely out of the ground to raise, lower, repair or replace worn or broken frames.

It has long been desirable to have a simple and easy way of providing an adjustable manhole frame member to avoid the necessity of digging up the entire manhole frame out of the ground which project entails a great deal of labor with air compressor equipment and jack hammers to cut through the pavement and to loosen the compacted fill with the accompanying great expense and traffic dusruption.

In an attempt to raise manholes without the necessity of digging out the entire structure, one prior technology utilized ring members for placement upon existing frame cover seats into which the covers are replaced. These ring members have limited use as their minimum overall height is greater than the height of the thinner layer of pavement used today. Also, if they are not carefully installed or do not properly fit the cover seat and cavity, these ring members can be dislodged and cause traffic accidents.

Many adjustable manhole frames are disclosed in the prior art. One is the "Preko" adjustable manhole frame disclosed in U.S. Pat. No. 3,858,998 which includes a second frame within an outer frame with screw adjustment means to raise or lower the inner second frame member in relation to the outer frame member so that if the road level is raised, one turns the screws on the manhole, and the inner frame will raise or lower the manhole cover to the desired height. These "Preko" adjustable manhole frames have not gained widespread usage in the industry because of their higher initial cost due to the complexity of machining that must be done to create them and to the inherent fear that the screw elements might jam and fail to operate after the frame has been installed for a long period of time.

Another adjustable type is the "self-level", a United Kingdom invention disclosed in U.S. Pat. No. 4,174,183. This frame is installed during paving operations and requires hot pavement as well as the use of a pavement roller for compression of the paving material and the positioning of the frame. A special exterior concrete ring is also required which is mortared to the base of the manhole. Height adjustments for this frame are limited to shallow height adjustments, and when the frame is raised, a void can be created that could trap water which, if frozen, could force the unit up into the traveled way. Further, unless care is taken to properly fill and compact around the frame's exterior, surface and underground liquids could undermine and/or deteriorate the frame support.

A further development in adjustable manhole frames is disclosed in my U.S. Pat. No. 4,536,103 which provides an improved adjustable manhole frame and method of construction utilizing a formed concrete base or base of brick or cement mortar that supports the frame of the invention in the pavement. As disclosed in this patent, the height and angle of the specially designed inner frame are determined by the method of installation which sets the height and angle of the formed concrete base as the frame is installed.

SUMMARY OF THE INVENTION

It is an object of this invention to disclose an improved frame for installation on manhole cones in similar fashion to the existing prior art but which frame can be easily raised to a new height without the necessity of extensive digging therearound that prior art frames with outwardly extending bottom flanges require. The frame of my new invention does not necessarily require the formation of a specially formed concrete base above the cone to hold it, and in one embodiment is positioned on the cone or on bricks built up on the cone with mortar in the same fashion that a standard prior art frame is installed. In my new invention the frame's lower bottom flange turns inward, instead of outward as in the prior art, to form an internal lower flange with mortar lock means to hold it in position and prevent its rotation. The outer wall of the frame has a dual slope so that the frame can be lifted out of position without the necessity of extensive digging up of the pavement and ground around it. Once the frame is lifted out of its position, concrete or brick and mortar can be positioned thereunder, and the frame can be dropped back into position at the new height on the new setting and tar or pavement material can be relaid up to the perimeter of the frame's top. More particularly the frame is structured having a seat which can be machined so that the cover can be set into the frame with the cover's top somewhat recessed from the top surface of the frame which design will prevent the cover's edges from being struck and will increase the life of the cover. The top surface of the frame can have letters or other indicia which are deeply recessed for improved anti-skid protection, and the outer edge of the top of the frame can be tapered down to the pavement so that it will not be struck by plows and the like which features enable the frame to last longer. The side wall of the frame which extends substantially perpendicularly and downward from the upper top surface which is generally level with the roadway, has a dual slope on its exterior surface the bottom of which extends inwardly so that it allows the frame to be lifted directly up with the lower portion of the side wall of the frame not engaging against the ground or other pavement material packed around the frame when it is lifted. This feature assists in allowing the frame to be lifted easily out of its position. The upper portion of the side wall slopes from the top outward approximately a third of the way down the exterior side to help form a pavement lock to hold the frame in place as the pavement will extend over this small portion of the frame. Such pavement lock is created by downward pressure of the traffic and even if a slight settlement of the fill occurs, the outward slope causes the downward moving pavement to tighten against the frame rather than pull away from it as would occur if the side wall were vertical.

To raise the frame to a new height, one can use a pavement cutter to cut into the pavement around the perimeter of the frame to separate the pavement from the frame at least as far down as the outwardly sloped upper portion of the side wall. The cut pavement is removed, and a frame lift device is installed within the frame. The frame is then lifted out manually or by equipment such as a front end loader. The lower inwardly sloped wall continues down to the base of the frame. At the base of the frame there is an inwardly extending, lower flange which extends inward and under the upper top surface of the frame and ends substantially in concentric alignment with the inner circumference of the cover seat. The lower flange can be made of separate segments or can be provided in one piece. The one-piece embodiment of the bottom flange can have a plurality of lock apertures defined therein. These apertures allow the mortar or concrete, whichever is used in the particular installation, that is placed under the surface of the inwardly extending lower flange, to move up into the lock apertures and which, when solidified, will harden therein and prevent the frame from rotating or otherwise moving in position to help hold it securely in place. The lock apertures can be tapered outwardly downward to help release the mortar lock when the frame must be lifted. When a segmented lower flange is used, the mortar or concrete hardens between the segments to help hold them in place. Under the frame's bottom flange there may be disposed mortar or brick between it and the cone because in many installations in order to have the frame, which may be 6 inches in height or less, reach the road surface, one must install brick and mortar on top of the cone up to the desired level and then place a layer of mortar onto which the frame is positioned. Then around the frame a waterproof mortar is filled in up to the level immediately under the pavement level, and the pavement is then placed over the upper slope of the side wall of the frame up to the tapered edge of the top of the frame. The frame can be provided in different sizes and shapes such as round or square for use as a catch basin.

DESCRIPTION OF THE PREFERRED EMBODIMENT(S)

Figure 1:
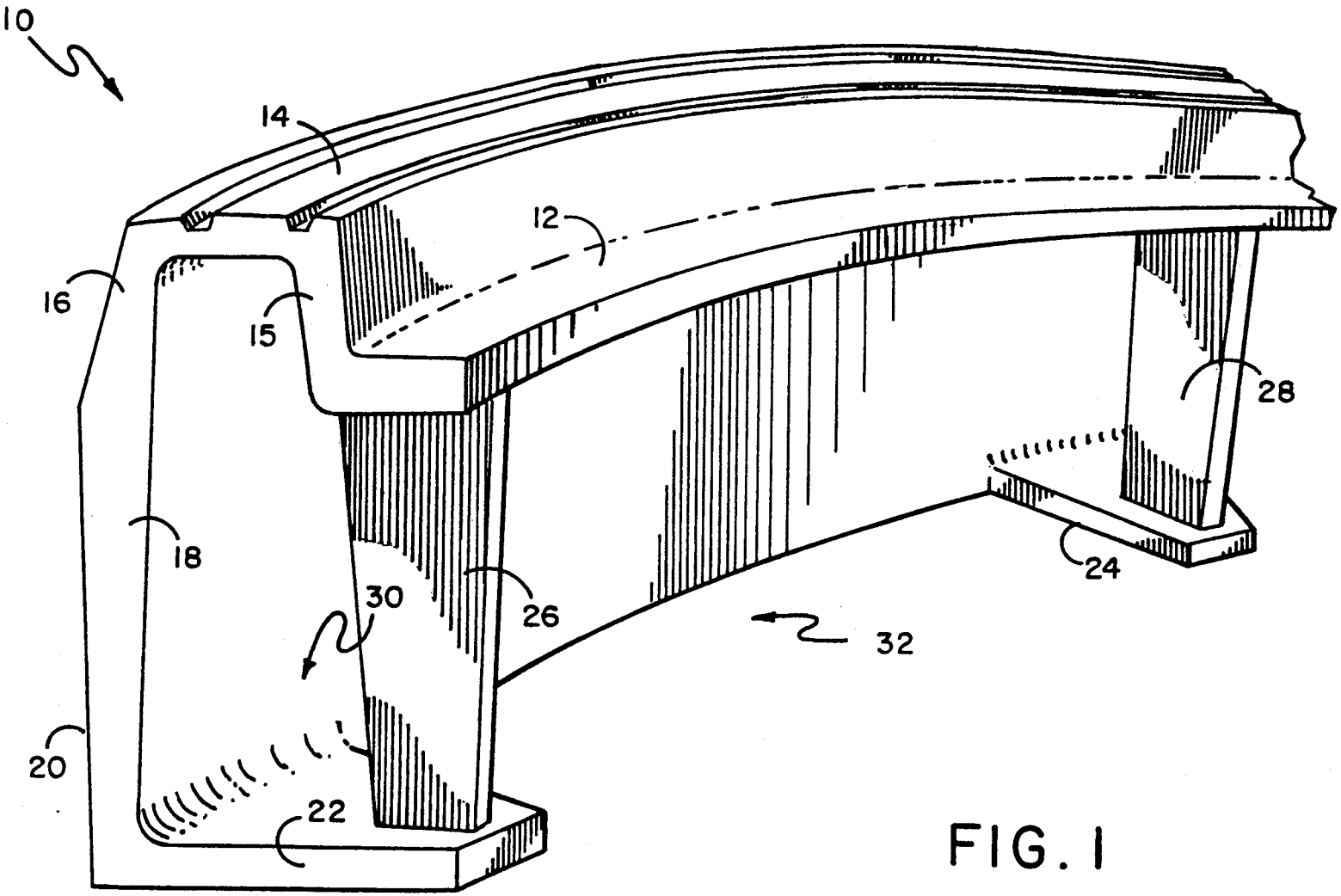
FIG. 1 illustrates a sectional cutaway view of the manhole frame of this invention having a segmented lower flange.
Figure 1A:
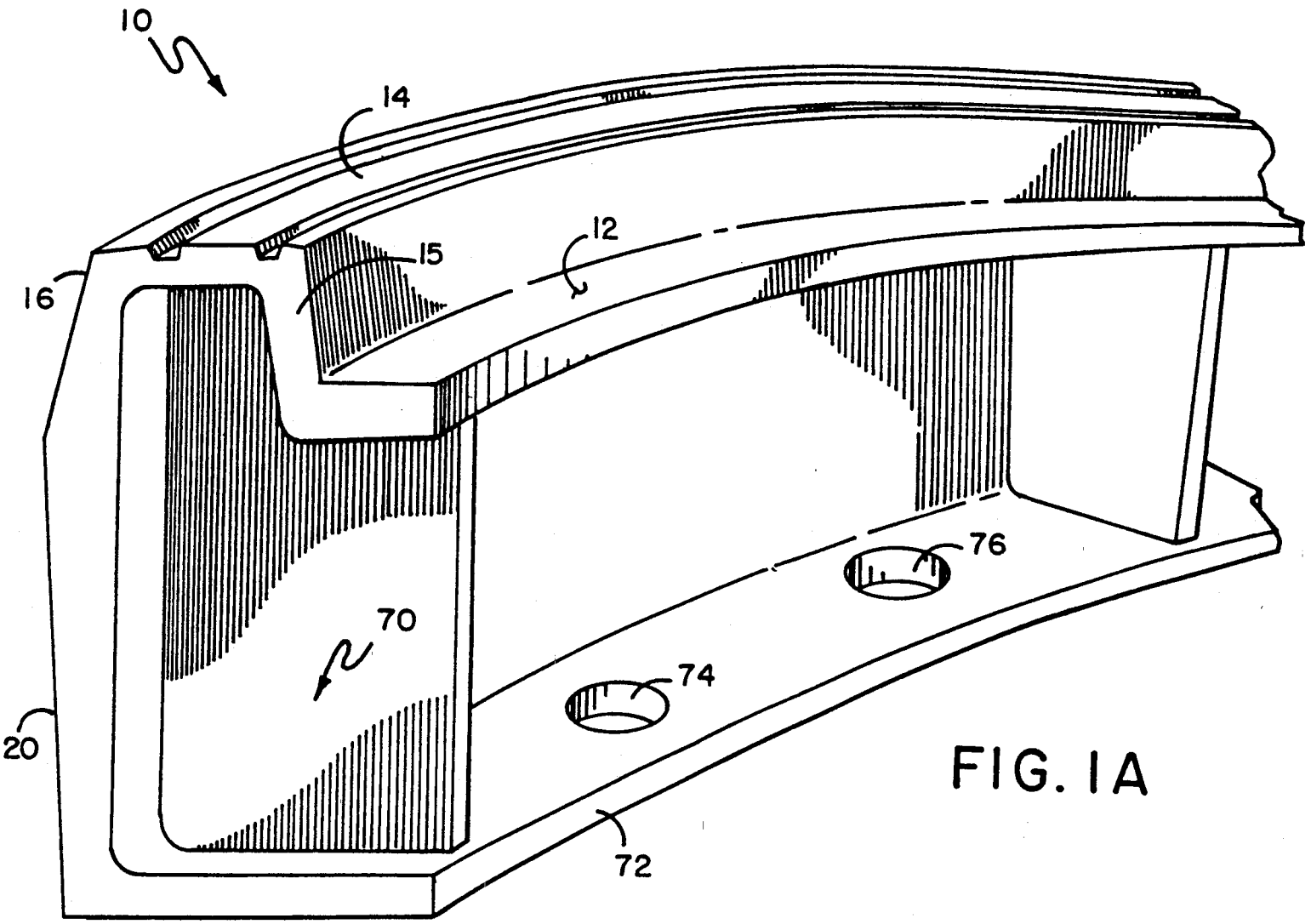
FIG. 1*a* illustrates a sectional cutaway view of the frame having a one-piece lower flange.

FIG. 1 illustrates a sectional cutaway view of one embodiment of the frame 10 of this invention having a segmented lower inwardly extending flange. FIG. 1*a* illustrates an alternative embodiment wherein the inwardly extending bottom flange is not segmented but extends in one piece around the entire circumference of the frame.

Figure 3:
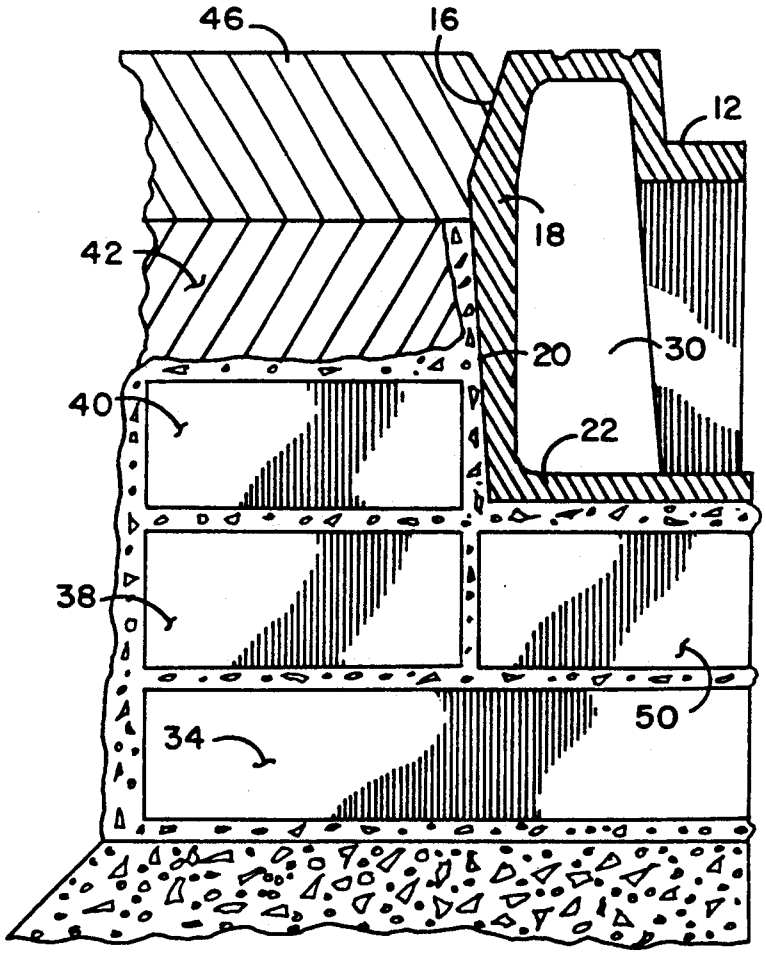
FIG. 3 illustrates the cross-sectional view of FIG. 2 with the frame in a raised position.
Figure 2:
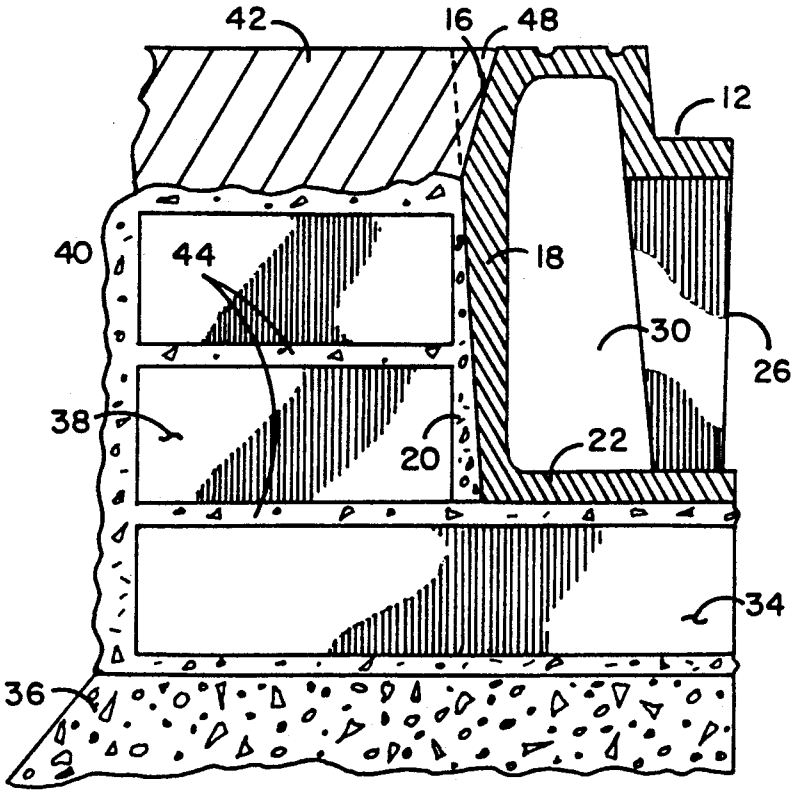
FIG. 2 illustrates a cross-sectional view of the frame installed above a manhole cone.

FIG. 2 illustrates a cross-sectional view of the frame installed above a manhole cone 36. In this cross-sectional view the elements of the frame are seen in relation to its installation environment. Because of the height of the frame, bricks 34 can be positioned above cone 36 upon which brick layer the frame is installed. Since the frame has no outwardly extending bottom flange, it does not have portions which extend under the installation bricks or mortar as is common in the prior art. The frame has side wall 18 with an upper outwardly extending slope 16 which slope extends approximately one-third of the way down side wall 18 of the frame and then joins an inwardly extending lower exterior slope 20 which extends to the bottom of the frame to the inwardly extending lower flange 22. As seen in FIG. 1, inwardly extending lower flange in one embodiment can be formed of segments such as segments 22 and 24 with ribs 26 and 28 extending respectively from these segments directly up to and under seat 12. The segments extend inwardly such that their inward terminal circumference is the approximate circumference of the opening within the manhole seat. The seat is adapted to receive the manhole cover which is not shown in these views but is well known in the art. By having lower exterior portion 20 of side wall 18 slope inwardly, one can easily lift this frame out of the ground, as will be described further below, by merely removing small segment 48 of pavement, as seen in FIG. 2, that overlaps the outer side wall of upper slope 16. This is a small cut that can be made around the outer perimeter of the frame. When this small segment of pavement is removed, the frame has no element of the brick, mortar or pavement holding it downward on its exterior and, once freed from its mortar lock at its base as will be described below, can be lifted directly out without disturbing the remaining bricks, for example bricks 38 and 40, therearound. Mortar 44 seen in FIGS. 2 and 3 extending around the brick can be of a Piaget type and hence waterproof and when the frame is lifted as seen in FIG. 3, bricks such as brick 50 can be placed above the originally positioned brick 34 and new mortar can be placed above brick 50. The frame can then be lowered onto the new mortar, and new pavement 46 can be applied over the old pavement 42, again covering over upper slope 16 of sidewall 18 which covering again helps to hold the frame in place. Other means also help hold the frame in position. For example, the mortar above brick 50 in the embodiment shown in FIG. 1 positions itself in the area 32 between the inwardly protruding lower flange segments 22 and 24, helping to lock them into place to prevent rotation and movement.

In FIG. 1*a* the inwardly extending lower flange 72 is shown formed as one piece extending around the circumference of the opening and can have formed therein a plurality of apertures such as lock apertures 74 and 76. These lock apertures can be downwardly and outwardly tapered and can receive the mortar therethrough which will help hold the frame in place. The frame utilizes ribs which can be either of the type that extend from the lower flange of the frame to under the seat, leaving a space 30 between the inside of the rib and the frame side wall 18 as seen in FIG. 1, or the ribs can be of the type seen in FIG. 1*a* where rib 70 extends the entire distance from under the seat and from the inside of inwardly extending lower flange 72 out to frame side wall 18.

Figure 4:
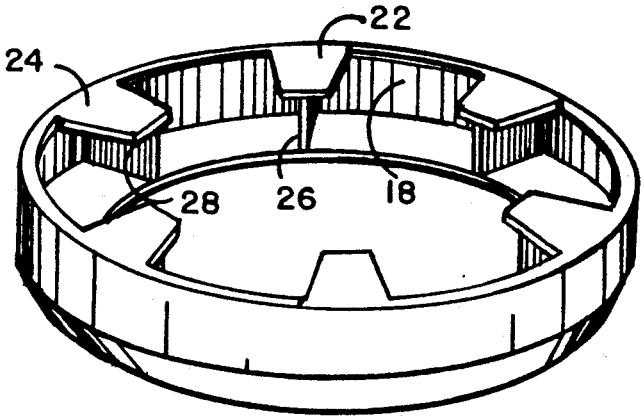
FIG. 4 illustrates a perspective bottom view of the frame having a segmented lower flange.

FIG. 4 is a perspective bottom view of the embodiment of the manhole frame seen in FIG. 1 showing six inwardly extending lower flange segments such as segments 22 and 24 above ribs 26 and 28, respectively. In this view sidewall 18 is also seen.

Figure 5:
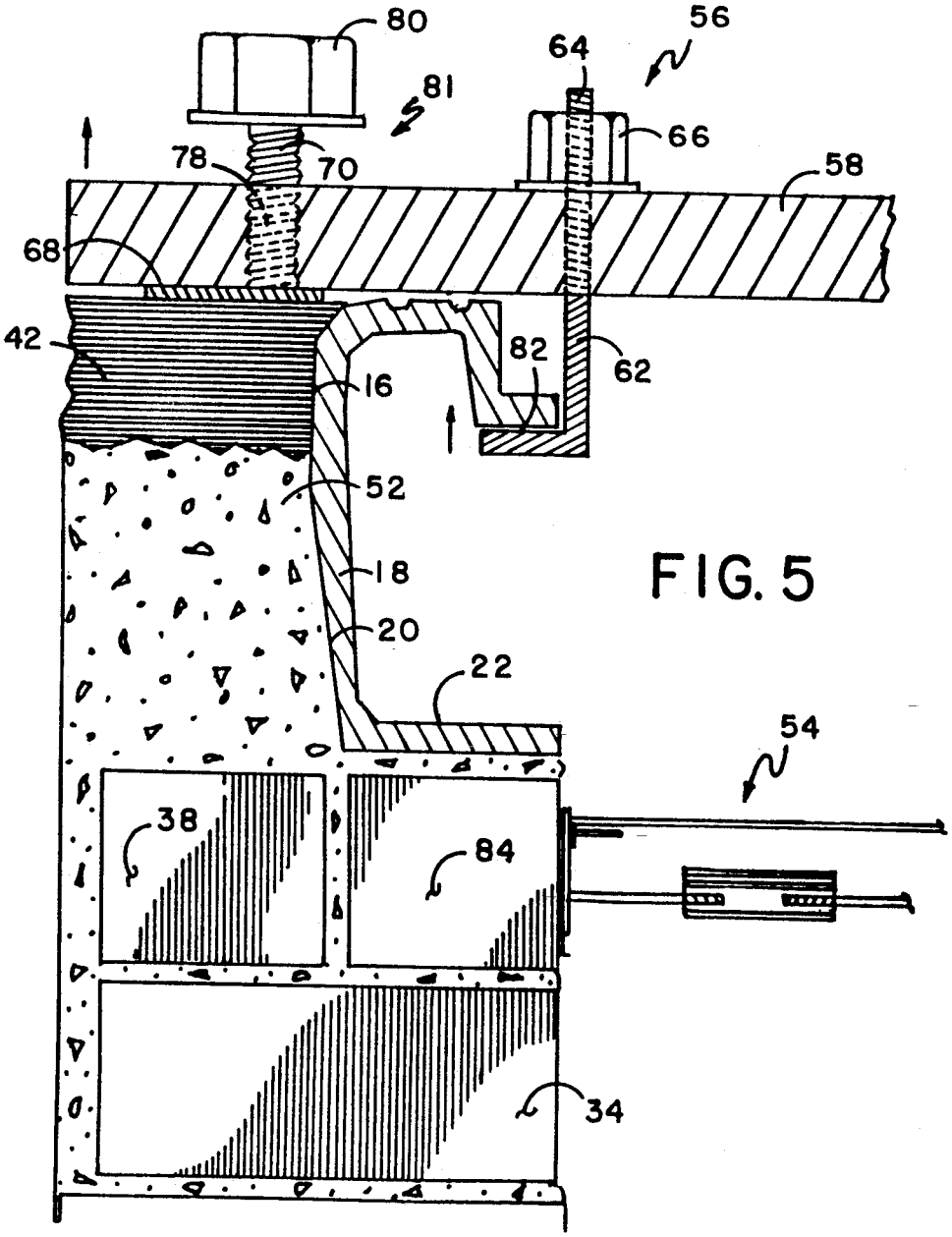
FIG. 5 illustrates a cross-sectional view of a frame in an alternate installation about to be lifted.

FIG. 5 illustrates an alternate bed for the frame of this invention. In this view the frame is embedded in frame bed 52 made of cement mixed with fiberglass. Under lower flange 22 is a series of bricks 84 which are placed with their long sides adjacent to the manhole opening so that they can be removed if one wishes in the future to lower the frame. The removal of this single course of bricks that does not extend into the surrounding bed simplifies the lowering process. In this view a manhole filling member 54 is used to occupy the open area in the manhole to prevent anything from falling into the hole while work is being done to raise or lower the frame. Frame bed 52 can be cast in place with a ring within the manhole opening to retain the cement in place to prevent it from falling down into the manhole. The frame bed also can be precast in the shop.

Figure 8:
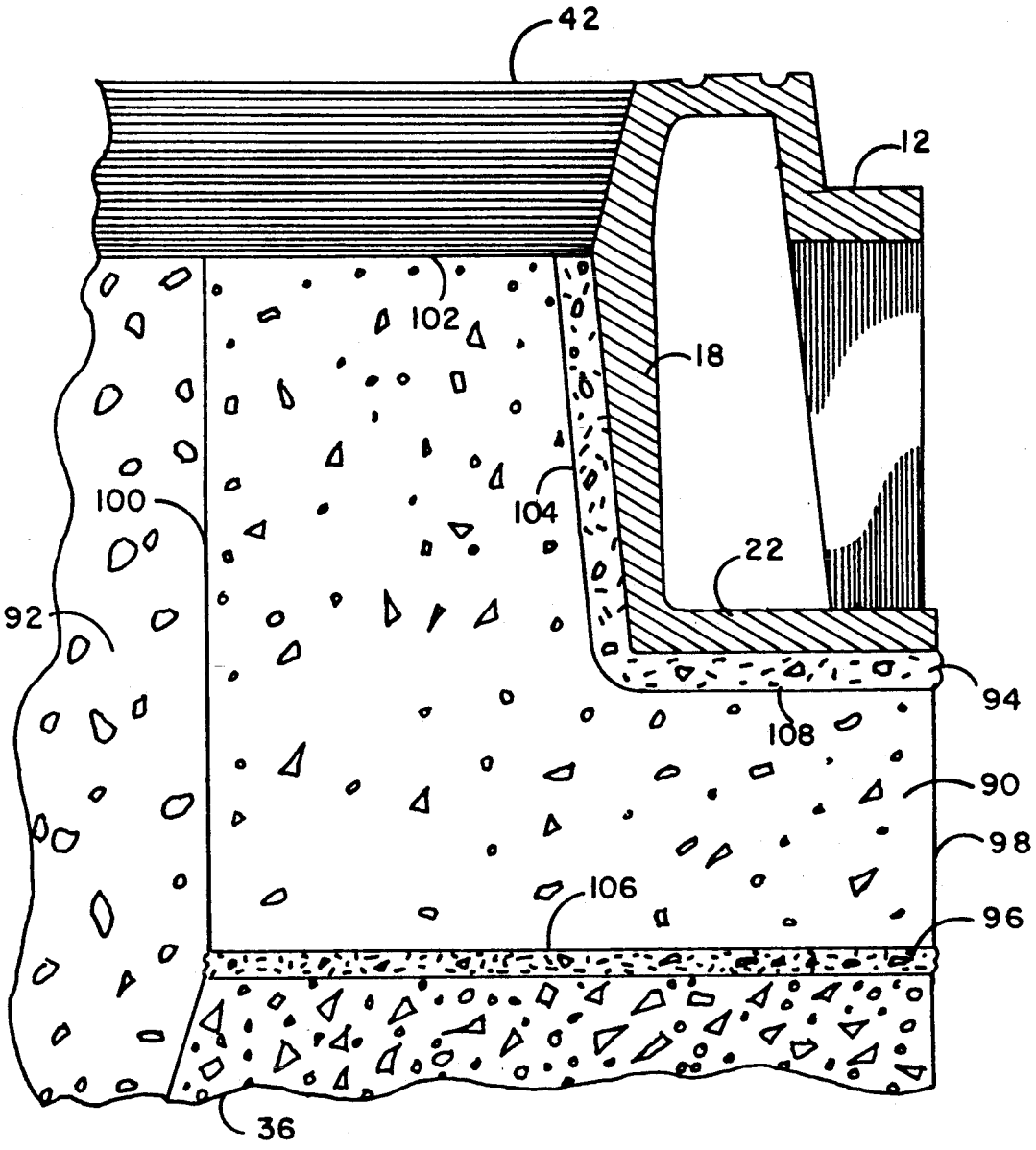
FIG. 8 illustrates a cross-sectional view of a concrete cradle to support the frame of this invention.

FIG. 8 illustrates a cross-sectional view of cradle 90 used to support the frame of this invention. This cradle is made of concrete instead of brick. Cradle 90 is cast off-site and shipped to the location of installation. Cradle 90 can have a layer of cement between itself and cone 36. Cement 94 is disposed between the frame and cradle 90. Cradle 90 can be 10 inches high on its outer surface 100 and 3 ½ inches wide at its top 102. The cradle can extend down approximately 3 inches on its inside surface 98 to cone 36. The inside wall 104 of cradle seat 108 can be slanted at an inward angle to match the angle of slope of lower exterior slope 20 of the frame. The use of a precast cradle facilitates installation as little or no brick work is required. The thickness of layers of cement 94 and 96 on each side can be adjusted in height to tilt cradle 90 and/or the frame to various desired angles to align the frame to the angle of the pavement.

Figure 6:
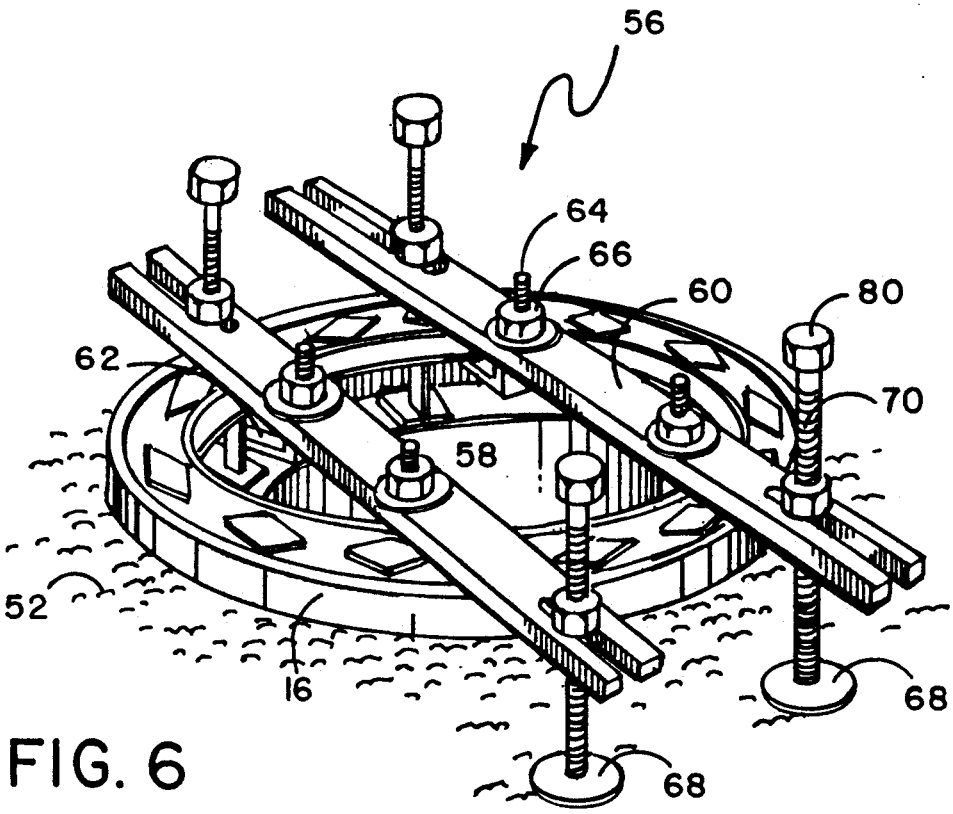
FIG. 6 illustrates an embodiment of a device to lift the frame of this invention.
Figure 7:
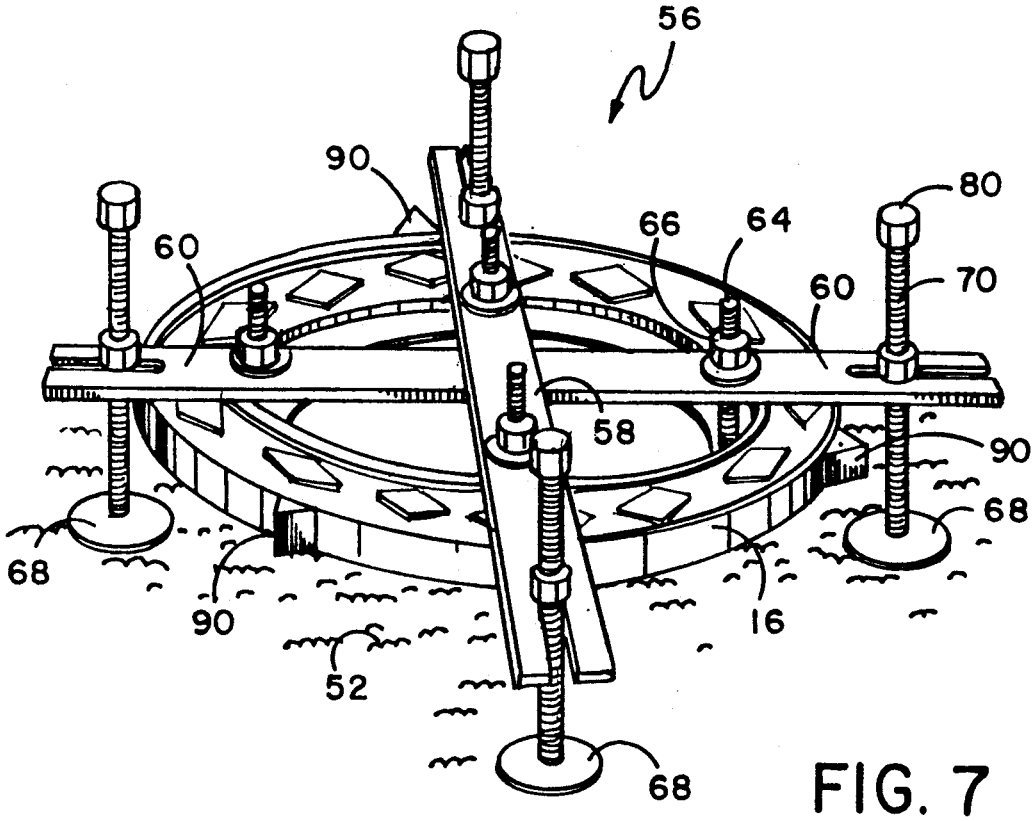
FIG. 7 illustrates an alternate embodiment of the device of FIG. 6 to lift the frame of this invention.

FIG. 6 illustrates a device 56 for lifting the frame of this invention which has pair of arms 58 and 60 which are placed above the manhole frame and clamped under seat 12 by clamps made of threaded member 62 which has arm extension member 82 attached thereto and passing under seat 12 as seen in FIG. 5. Threaded member 62 passes through arm 58 and has nut 66 threaded thereon such that when nut 66 is tightened, extension member 82 is pulled tightly against the bottom of seat 12. There are two clamp members per arm, each clamp member engageable to a section of the frame. Each arm at its end is supported by an arm support, such as arm support member 81 seen in FIG. 5. Each arm support member has a threaded portion 70 engaged in a threaded portion 78 at each end of each arm. By rotating cap 80 by a socket wrench, threaded portion 70 rotates and screws downward on plate 68, raising each respective end of arms 58 and 60 and lifting them and the attached frame out of frame bed 52 as seen in FIG. 6. FIG. 6 shows arms 58 and 60 parallel to one another while FIG. 7 shows arms 58 and 60 crossing one another at 90 degrees to one another where they are attached at their point of intersection. FIG. 7 also illustrates pointed guide members 90 which can be formed with the frame and help to realign the frame in the exact position it was originally installed by realigning the guides with the groove each made in the frame bed. Unless the frame is accurately realigned, it can experience difficulty in re-engaging with the opening in the bed during relowering of the frame after any lifting thereof has occurred. Upon rotation of each of the caps 80, arms 58 and 60 will lift the frame directly out of the manhole to a desired height where additional material such as bricks and mortar can be placed thereunder if the frame is to be repositioned at a higher level.

To raise the frame of this invention, as discussed above, a section of the pavement must be first cut away from around the edges of upper slope 16, but since this section occupies only a very small horizontal portion around the perimeter of the frame, this removed section is very small. When the frame is lifted by the device as seen in FIG. 5 and after mortar spacing material has been placed underneath, if needed, to cause the frame to be at its new height, the frame can then be lowered onto the new mortar placed around the inside of the hole and the pavement can then be applied up to the top edge of frame 10 such that the pavement then covers over the upper slope 16 and helps lock the frame in place along with the mortar extending either through lock apertures 74 in the embodiment of FIG. 1*a* or around and between the lower flange segments such as segments 22 and 24 in the embodiment of FIG. 1.

In a preferred embodiment the frame of this invention can be approximately 3 ½ inches in depth from its inner circumference to its outer wall and approximately 6 inches in height. The design of the frame is suitable for either round manhole frames or square frames such as used for catch basins. The tapered outer edge of the top of the frame helps to minimize damage that could be caused such as by blades of plows scraping the pavement. The mortar at the base of the frame, either within the lock apertures or around the inwardly extending flange segments, locks the frame in place, adding to its stability and preventing unwanted rotation of the frame.

The frame of this invention can be manufactured from cast iron, ductile iron or any equivalent material that will be strong and durable. Ductile iron has a significant advantage over cast iron in that it is lighter in weight. The installation can utilize lime-free mortar for additional strength combined with a double brick backing and with bituminous-type paving. The opening for the seat cover can be machined in this type of frame for accurate positioning of the cover. The use of the frame of this invention has many significant advantages over prior art adjustable frames. Since the costs for excavation and pavement repair in the raising and repositioning of manhole frames today can be more costly than the cost of the total original installation, the use of the frame of this invention which involves little digging lowers the cost for raising and repositioning the frame compared to the cost of raising and repositioning frames of the prior art.

Although the present invention has been described with reference to particular embodiments, it will be apparent to those skilled in the art that variations and modifications can be substituted therefor without departing from the principles and spirit of the invention.

I claim:

1. A frame disposed in surmounting relation to a manhole cone to define a manhole opening at pavement level, said opening being closable by a manhole cover, said frame further being capable of adjustment relative to said manhole cone and to said pavement level, comprising:

a horizontally extending top member having an interior end and an exterior end with a centrally disposed opening defined therein, the circumference of said opening defining said top member's interior end;

a seat integrally defined in said top member around said opening;

a side wall having a height, a top, a bottom, an inner, side, an outer side, an upper exterior portion having a slope and a lower exterior portion having a slope, said side wall extending substantially vertically downward from said exterior end of said top member, said side wall formed integrally with said top member; and a horizontally disposed lower flange formed integrally with said side wall, said lower flange extending inwardly from the bottom of said side wall and disposed beneath said top member, said lower flange having a centrally disposed lower opening defined therein, said lower opening corresponding to, and disposed beneath, said centrally disposed upper opening in said top member, said lower flange characterized by not having any portion thereof extending outward from said side wall.

2. The frame of claim 1 further including a plurality of lock apertures defined in said lower flange.

3. The frame of claim 1 wherein said horizontally disposed inwardly extending lower flange is formed of a plurality of spaced-apart segments.

4. The frame of claim 1 further including a plurality of rib members, each of said rib members integrally extending from said lower flange and joining said top member.

5. The frame of claim 1 wherein said upper exterior portion of said side wall slopes outward and downward from said top member a distance from said top member, said lower exterior portion of said side wall then sloping inwardly and downward to the bottom of said side wall.

6. The frame of claim 1 wherein said slope of said upper exterior portion extends outward and downward a distance approximately one-third the height of said side wall and said slope of said lower exterior portion extends inward and downward a distance corresponding to the remainder of the height of said sidewall.

* * * * *